US012662844B2

(12) United States Patent
Wang

(10) Patent No.: US 12,662,844 B2
(45) Date of Patent: Jun. 23, 2026

(54) DOUBLE-ROOF FOLDABLE TENT

(71) Applicant: XIAMEN MOQI INDUSTRY AND TRADE CO., LTD., Xiamen City (CN)

(72) Inventor: Xingling Wang, Xiamen City (CN)

(73) Assignee: XIAMEN MOQI INDUSTRY AND TRADE CO., LTD., Xiamen City (CN)

( * ) Notice: Subject to any disclaimer, the term of this patent is extended or adjusted under 35 U.S.C. 154(b) by 233 days.

(21) Appl. No.: 18/612,688

(22) Filed: Mar. 21, 2024

(65) Prior Publication Data

US 2024/0318458 A1 Sep. 26, 2024

(30) Foreign Application Priority Data

Mar. 25, 2023 (CN) ..... 202320609732.5

(51) Int. Cl.
*E04H 15/50* (2006.01)
*E04H 15/16* (2006.01)
*E04H 15/46* (2006.01)
*E04H 15/60* (2006.01)

(52) U.S. Cl.
CPC ..... *E04H 15/50* (2013.01); *E04H 15/16* (2013.01); *E04H 15/46* (2013.01); *E04H 15/60* (2013.01)

(58) Field of Classification Search
CPC ..... E04H 15/50
See application file for complete search history.

(56) References Cited

U.S. PATENT DOCUMENTS 6,868,858 B2 * 3/2005 Suh ..... E04H 15/48 135/145
6,951,327 B1 * 10/2005 Seo ..... F16B 7/0446 248/188
8,544,489 B2 * 10/2013 Choi ..... E04H 15/50 135/147
10,072,439 B2 * 9/2018 Lovley, II ..... E04H 15/46
10,487,531 B2 * 11/2019 Volin ..... E04H 15/16
11,230,858 B2 * 1/2022 Yuan ..... E04H 15/48
11,851,903 B2 * 12/2023 Sun ..... E04H 15/50
12,037,808 B2 * 7/2024 Sun ..... E04H 15/50
2003/0024563 A1 * 2/2003 Liu ..... E04H 15/50 135/145
2003/0164185 A1 * 9/2003 Price ..... E04H 15/50 135/131
2006/0260666 A1 * 11/2006 Choi ..... E04H 15/50 135/94

(Continued)

*Primary Examiner* — Noah Chandler Hawk

(57) ABSTRACT

Disclosed is a double-roof foldable tent. The double-roof foldable tent includes a tent roof connection block, where a plurality of double-roof assemblies are arranged at a bottom of the tent roof connection block, the double-roof assemblies include connection rods, the connection rods are arranged at the bottom of the tent roof connection block, one sides of the connection rods are fixedly connected to fastener posts, the one sides of the connection rods are provided with double-roof rods, and one sides of the double-roof rods are provided with double-roof linkage rods. When the tent is unfolded, a ventilation gap is formed so that more wind passes through the gap, and a ventilation effect is better. Since wind passes through the gap, wind resistance is smaller, the use stability is improved, and air inside the tent can flow sufficiently. The tent can be folded as a whole and is convenient to store.

9 Claims, 14 Drawing Sheets

(56) References Cited

U.S. PATENT DOCUMENTS

| | | | | |
|---|---|---|---|---|
| 2014/0099155 | A1* | 4/2014 | Chen | E04H 15/46<br>403/83 |
| 2022/0268052 | A1* | 8/2022 | Sun | E04H 15/16 |
| 2024/0263482 | A1* | 8/2024 | Zhu | E04H 15/54 |

* cited by examiner

DOUBLE-ROOF FOLDABLE TENT

CROSS REFERENCE TO RELATED APPLICATION

This application claims priority benefit of Chinese patent Application No. 202320609732.5, filed on Mar. 25, 2023, and the entire contents of which are incorporated herein by reference.

TECHNICAL FIELD

The disclosure relates to the technical field of tents, and in particular to a double-roof foldable tent.

BACKGROUND

A tent, a type of canopy supported on the ground to shelter from wind, rain, and sunlight for temporary living, is typically made of canvas. It can be detached and transferred freely together with supporting parts. Being convenient to carry and store, a foldable tent is more popular and can be formed into a large tent with a wide shelter area when being unfolded.

With tent cloth simply supported through a tent frame, an existing tent forms a closed structure as a whole when being set up, leading to unsatisfactory ventilation performance. Further, a tent body is large-sized when being unfolded. In consequence, the tent encounters great wind resistance when being used outdoors. Accordingly, the use stability of the tent is inevitably affected in the presence of strong wind.

SUMMARY

In view of the above, the disclosure provides a double-roof foldable tent. A top of the tent is formed into a two-layer structure through double-roof assemblies, so that better ventilation can be realized, and the problem that a tent body is large-sized when being unfolded and encounters great wind resistance, so that the use stability of the tent is affected in the presence of strong wind is solved.

In order to realize the above objective, the disclosure provides the technical solution as follows: a double-roof foldable tent includes a tent roof connection block, where a plurality of double-roof assemblies are arranged at a bottom of the tent roof connection block, the double-roof assemblies includes connection rods, the connection rods are arranged at the bottom of the tent roof connection block, one sides of the connection rods are fixedly connected to fastener posts, the one sides of the connection rods are provided with double-roof rods, and one sides of the double-roof rods are provided with double-roof linkage rods; one ends of the connection rods are connected to connection blocks, the other ends of the connection blocks are connected to long rods, the other ends of the long rods are connected to corner connection blocks, one sides of the long rods are provided with short rods, and one ends of the short rods are connected to fastener blocks; fastener buttons are arranged inside the fastener blocks, movable supporting rods are inserted into the fastener blocks and the corner connection blocks, the movable supporting rods are internally fixedly connected to leaf springs I, fixed supporting rods are inserted into the movable supporting rods, the fixed supporting rods are internally fixedly provided with leaf springs II, the fixed supporting rods are snapped into rod sleeves, and the rod sleeves are fixedly connected to inner walls of the movable supporting rods; and a foldable unit is arranged between every two double-roof assemblies, and the foldable unit includes a foldable supporting rod I and a foldable supporting rod II.

Preferably, tops of the connection rods are movably connected to the tent roof connection block through rotary shafts, the connection rods are movably connected to the double-roof rods through rotary shafts, and bottoms of the connection rods are movably connected to the connection blocks through rotary shafts.

Preferably, tops of the double-roof linkage rods are movably connected to the double-roof rods through rotary shafts, and bottoms of the double-roof linkage rods are movably connected to the long rods through rotary shafts.

Preferably, tops of the long rods are movably connected to the connection blocks through rotary shafts, and bottoms of the long rods are movably connected to the corner connection blocks through rotary shafts.

Preferably, tops of the short rods are movably connected to the long rods through rotary shafts, and bottoms of the short rods are movably connected to the fastener blocks through rotary shafts.

Preferably, the corner connection blocks are fixedly arranged at tops of the movable supporting rods.

Preferably, the movable supporting rods are snapped into the fastener blocks, and the fastener blocks are slidably connected to the movable supporting rods.

Preferably, a top of the foldable supporting rod I is movably connected to one corner connection block through a rotary shaft, and a bottom of the foldable supporting rod I is movably connected to one fastener block through a rotary shaft.

Preferably, a top of the foldable supporting rod II is movably connected to another corner connection block through a rotary shaft, and a bottom of the foldable supporting rod II is movably connected to another fastener block through a rotary shaft.

Preferably, an intersection between the foldable supporting rod I and the foldable supporting rod II is movably connected through a rotary shaft.

Embodiments of the disclosure have the advantages as follows:

1. When the tent is unfolded, a ventilation gap is formed between upper-layer tent cloth supported by the double-roof rods and lower-layer tent cloth supported by the long rods and the connection rods. Accordingly, more wind passes through the gap, and a ventilation effect is better. Since wind passes through the gap, less wind blows to a tent body, wind resistance is smaller, the use stability is improved, and air inside the tent can flow sufficiently.
2. By pressing the fastener buttons, limitation on movement of the fastener blocks along the movable supporting rods is released. The plurality of fastener blocks are dragged downwards, so that the foldable supporting rod I and the foldable supporting rod II are folded towards each other. Moreover, when the fastener blocks move downwards, the long rods are bent downwards through the short rods, so that the long rods, the connection rods, and the double-roof linkage rods are folded. When the fastener blocks move to the leaf springs II, the leaf springs II are retracted into the fixed supporting rods, so that limitation on movement of the movable supporting rods along the fixed supporting rods is released. The movable supporting rods slide to store the fixed supporting rods into the movable supporting rods, so that the tent contracts to be folded as a whole, and is convenient to store.

BRIEF DESCRIPTION OF FIGURES

In order to describe the technical solutions in the implementation of the disclosure or the prior art more clearly, the accompanying drawings required for describing the implementation or the prior art will be briefly described below. Obviously, the accompanying drawings in the following description are merely illustrative. Those of ordinary skill in the art can also derive other implementation accompanying drawings from the accompanying drawings provided without creative efforts.

The structure, proportion, size, etc. shown in the description are merely used to jointly explain the contents disclosed in the description for understanding and reading by those skilled in the art, are not intended to limit the restrictive conditions implementable by the disclosure, and thus have no technical substantive meanings. Without affecting the effect and objectives realizable by the disclosure, any structural modification, proportion relation change, or size adjustment should still fall within the scope that the technical contents disclosed in the disclosure can cover.

Figure 1:
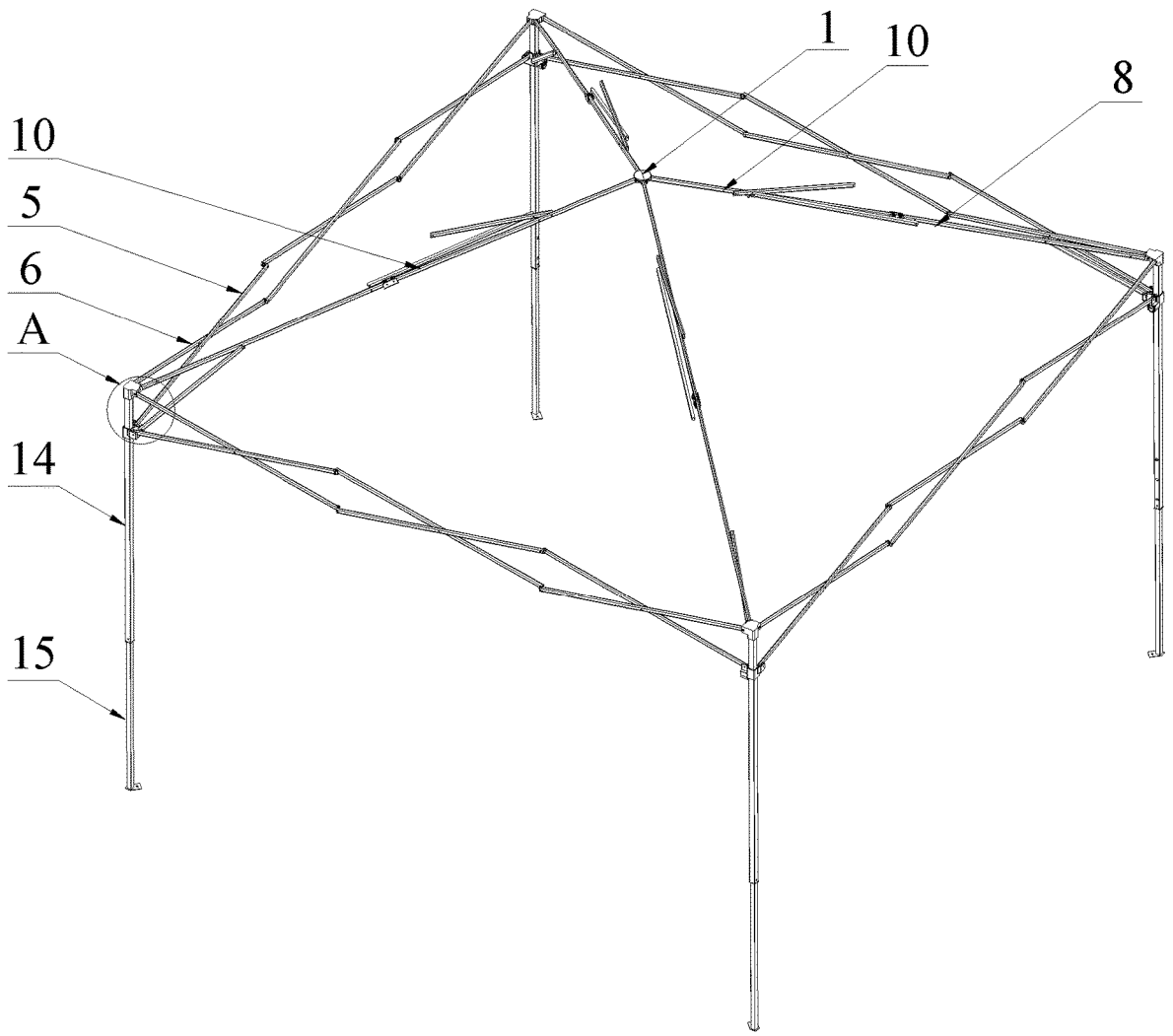
FIG. 1 is an overall schematic structural diagram according to the disclosure.
Figure 2:
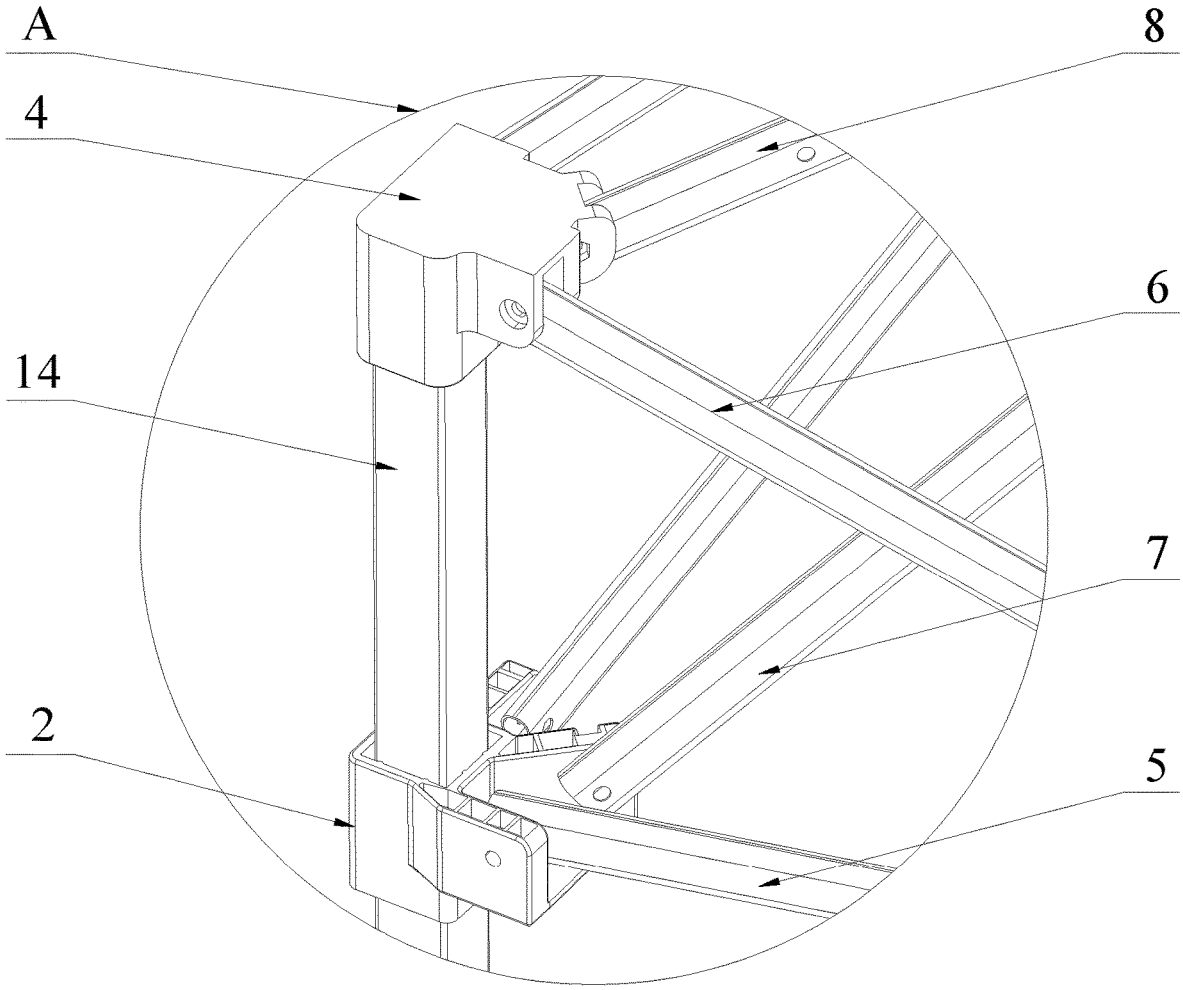
FIG. 2 is an enlarged structural diagram of portion A in FIG. 1 according to the disclosure.
Figure 3:
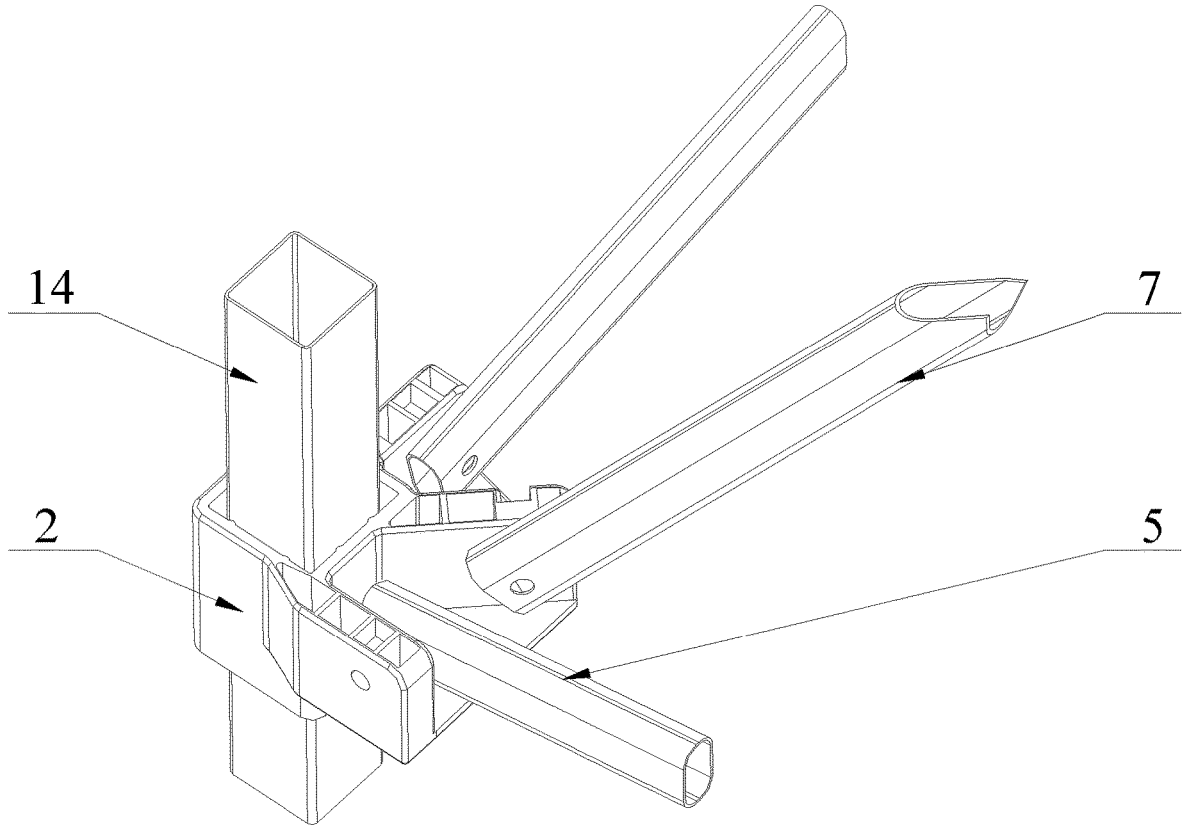
FIG. 3 is a solid sectional diagram of part of a front-view connection relation at a fastener block according to the disclosure.
Figure 4:
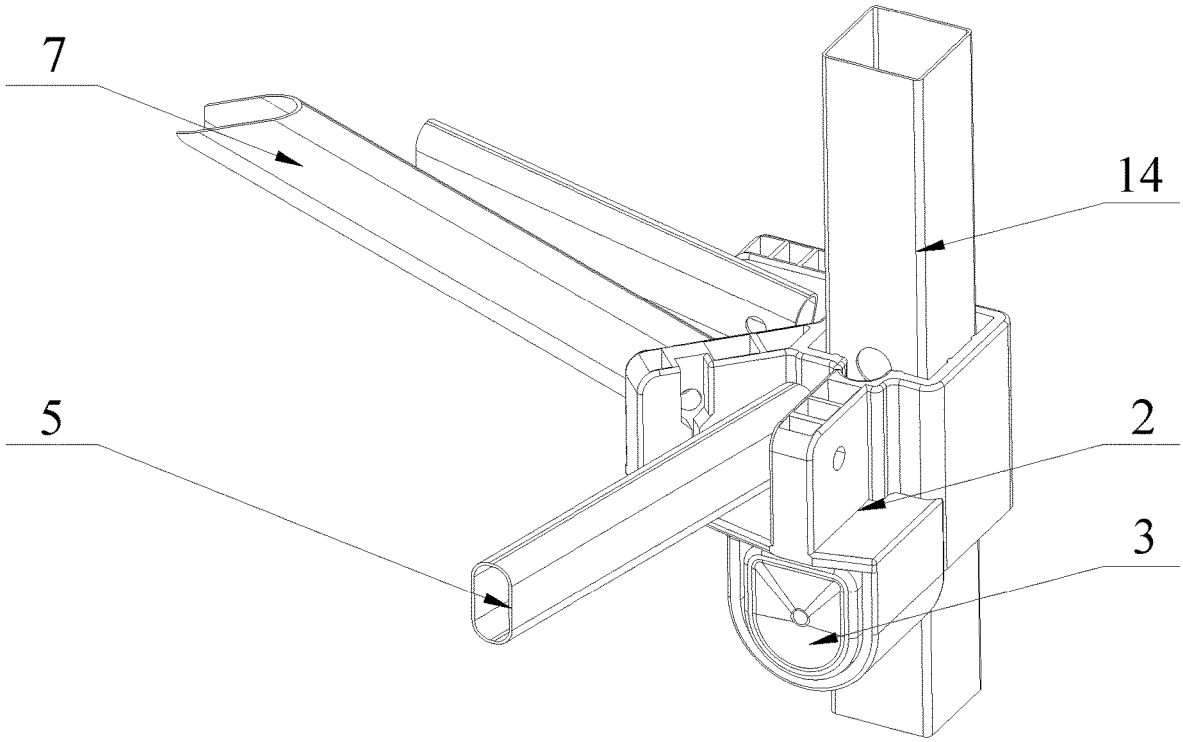
FIG. 4 is a solid sectional diagram of part of a left-view connection relation at a fastener block according to the disclosure.
Figure 5:
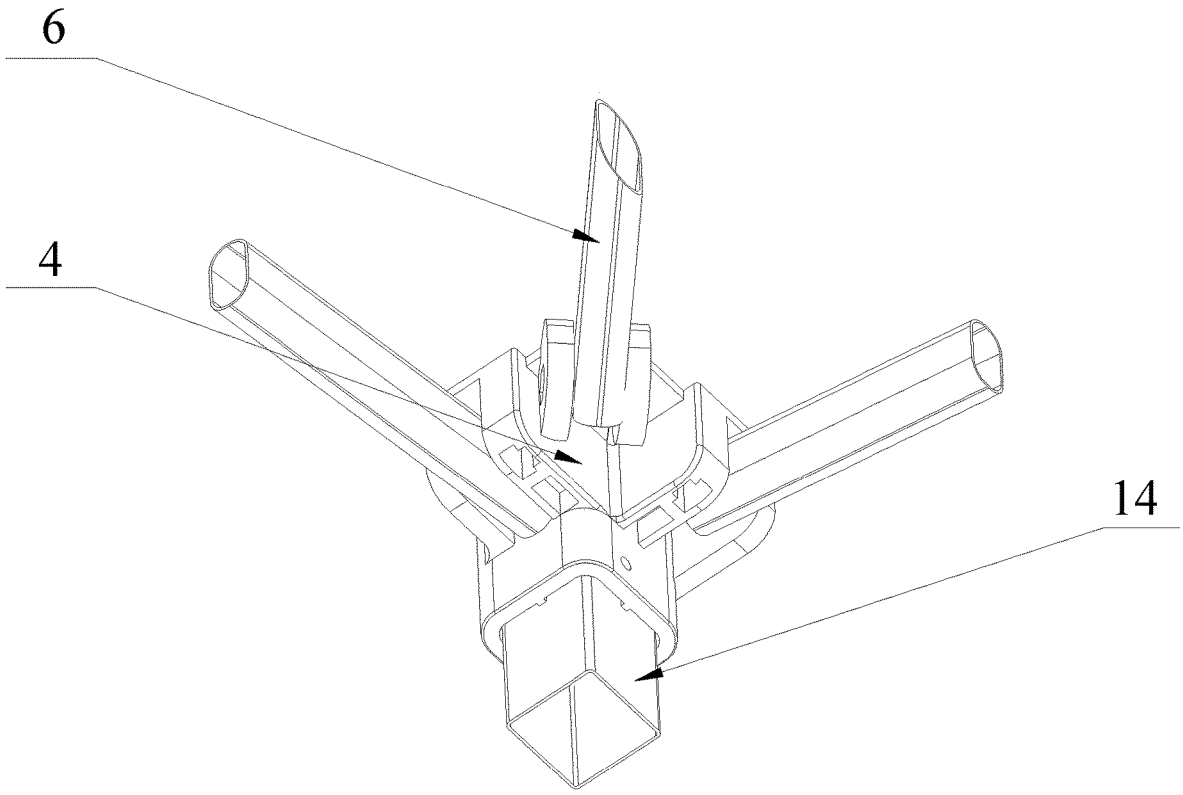
FIG. 5 is a solid sectional diagram of part of a bottom-view connection relation at a corner connection block according to the disclosure.
Figure 6:
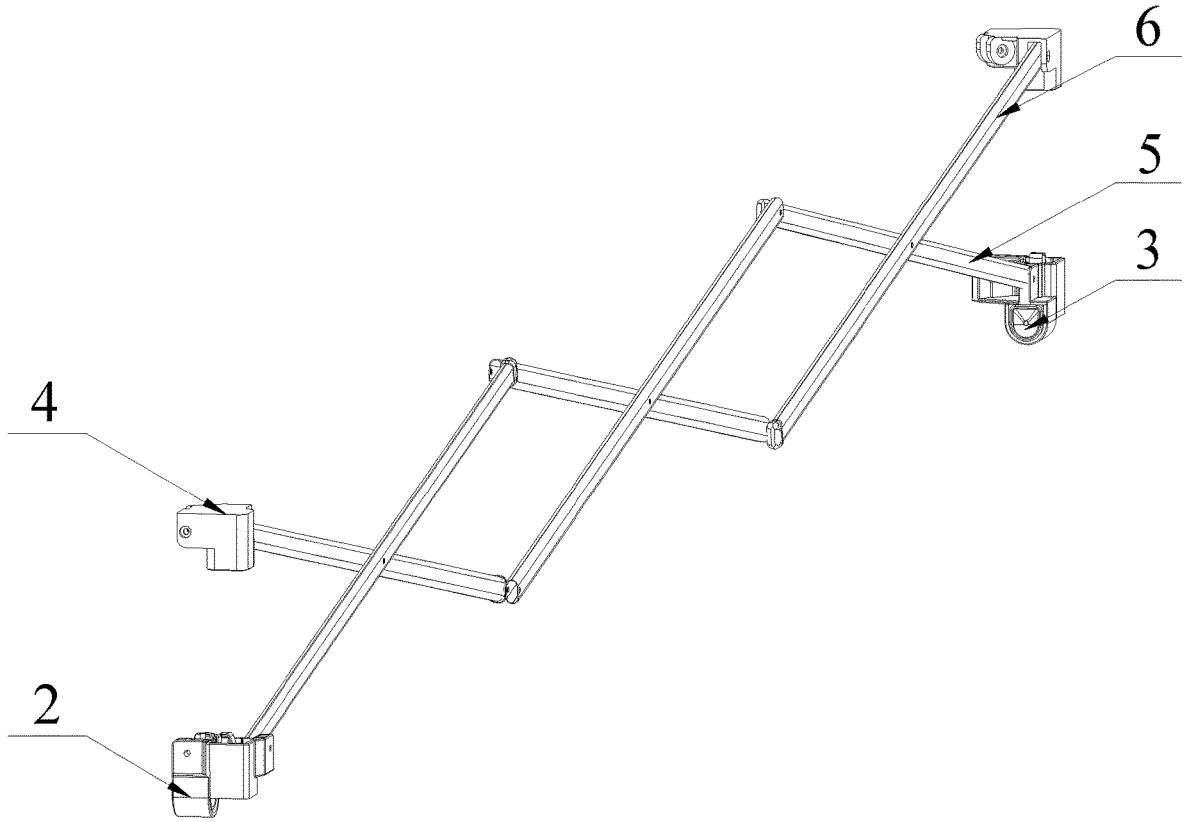
FIG. 6 is a solid diagram of a foldable unit according to the disclosure.
Figure 7:
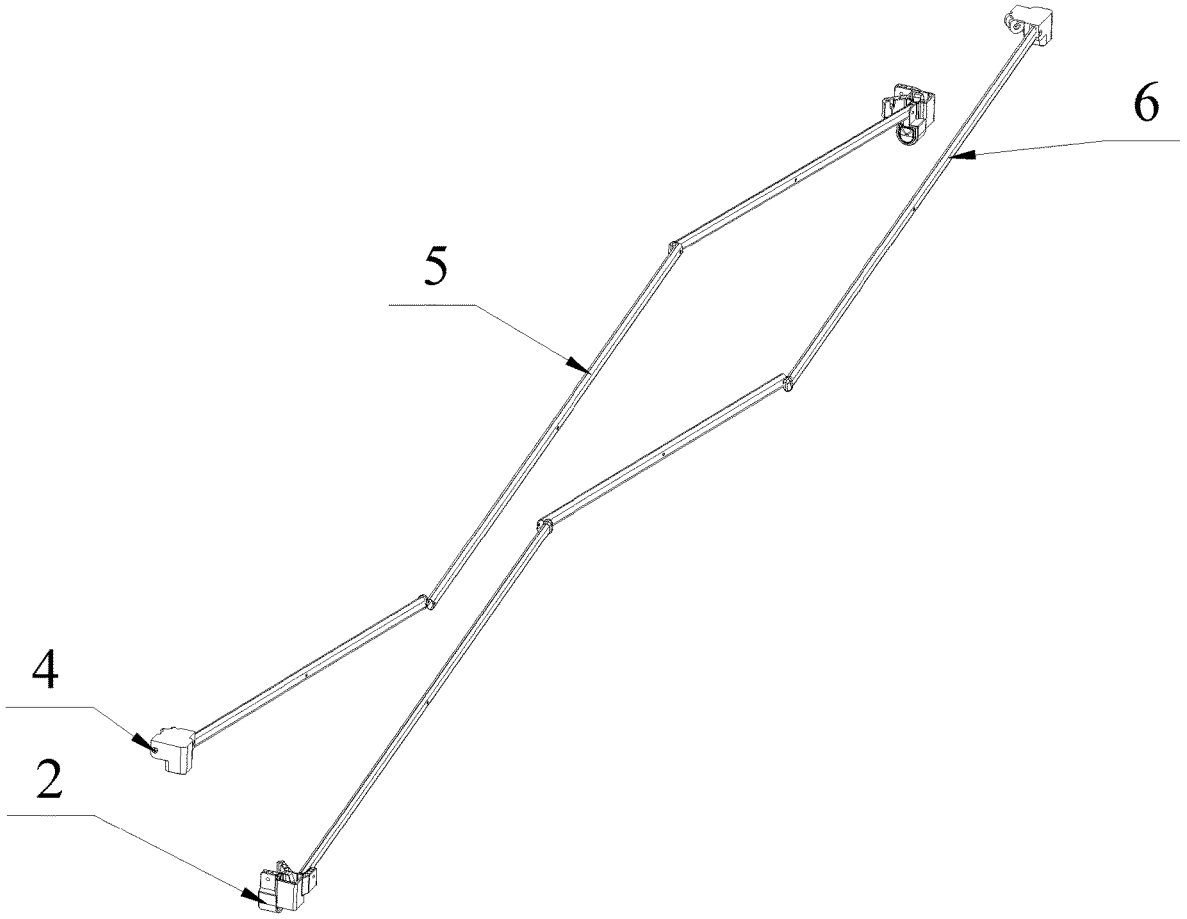
FIG. 7 is a solid exploded diagram of part of a foldable unit according to the disclosure.
Figure 8:
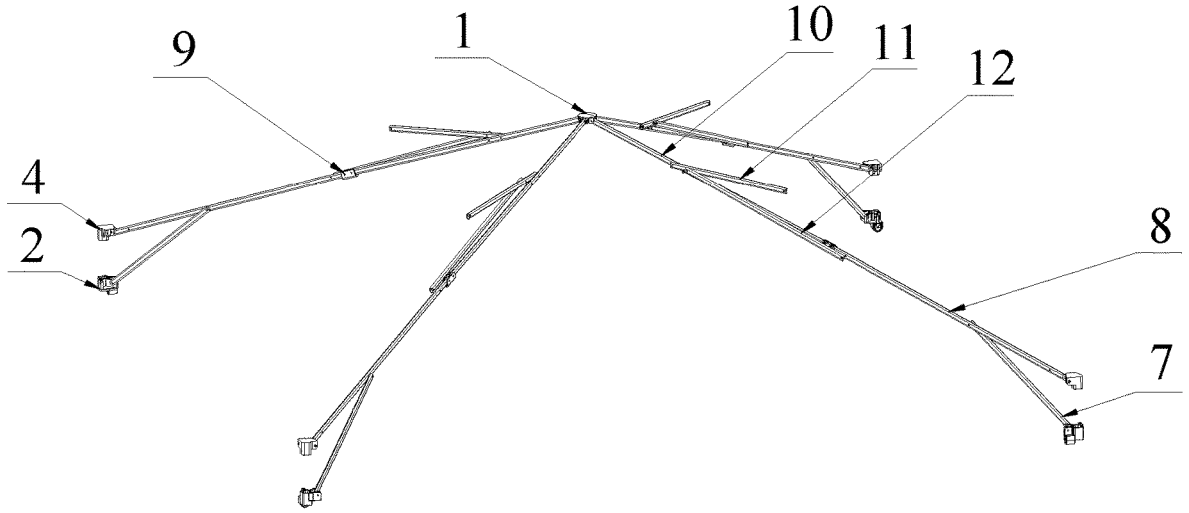
FIG. 8 is a solid diagram of a connection relation of a double-roof assembly according to the disclosure.
Figure 9:
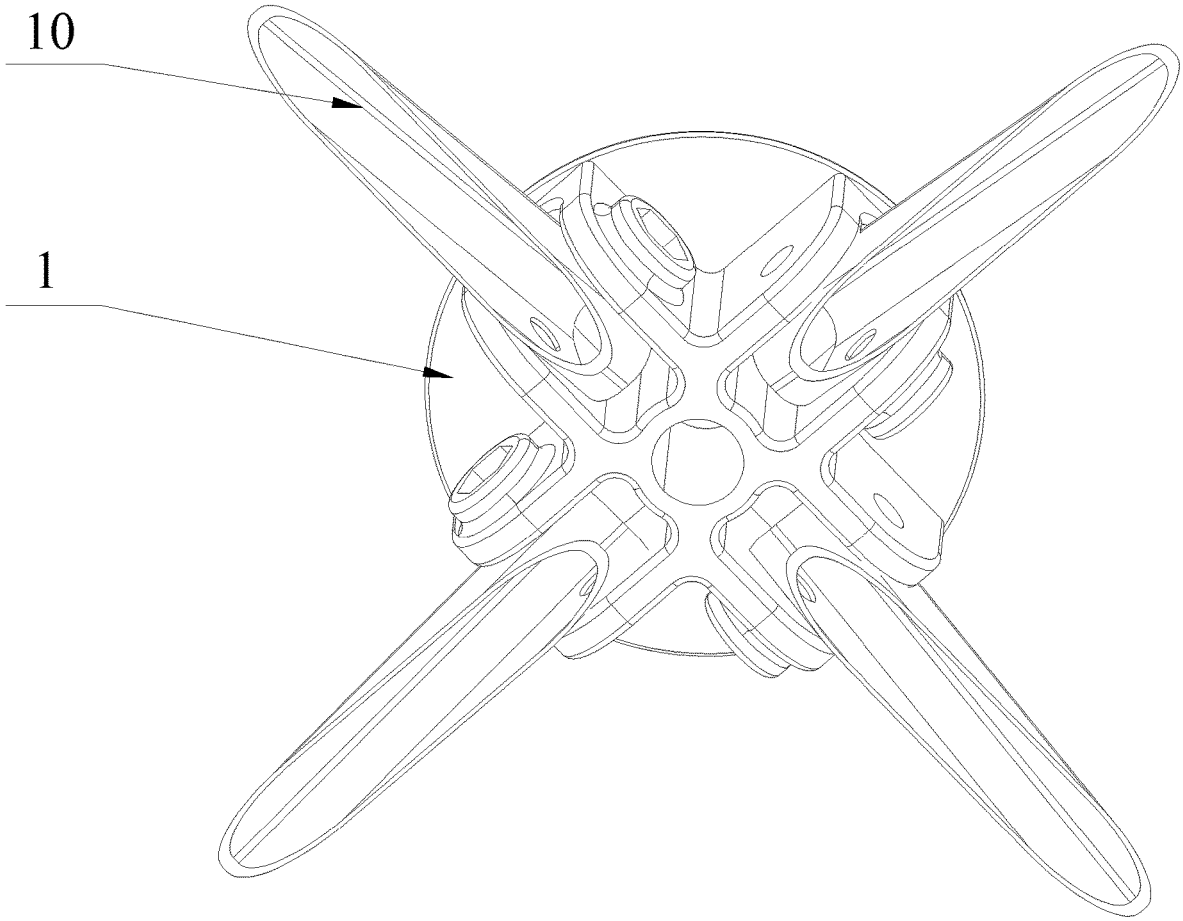
FIG. 9 is a solid sectional view of part of a bottom-view connection relation at a tent roof connection block according to the disclosure.
Figure 10:
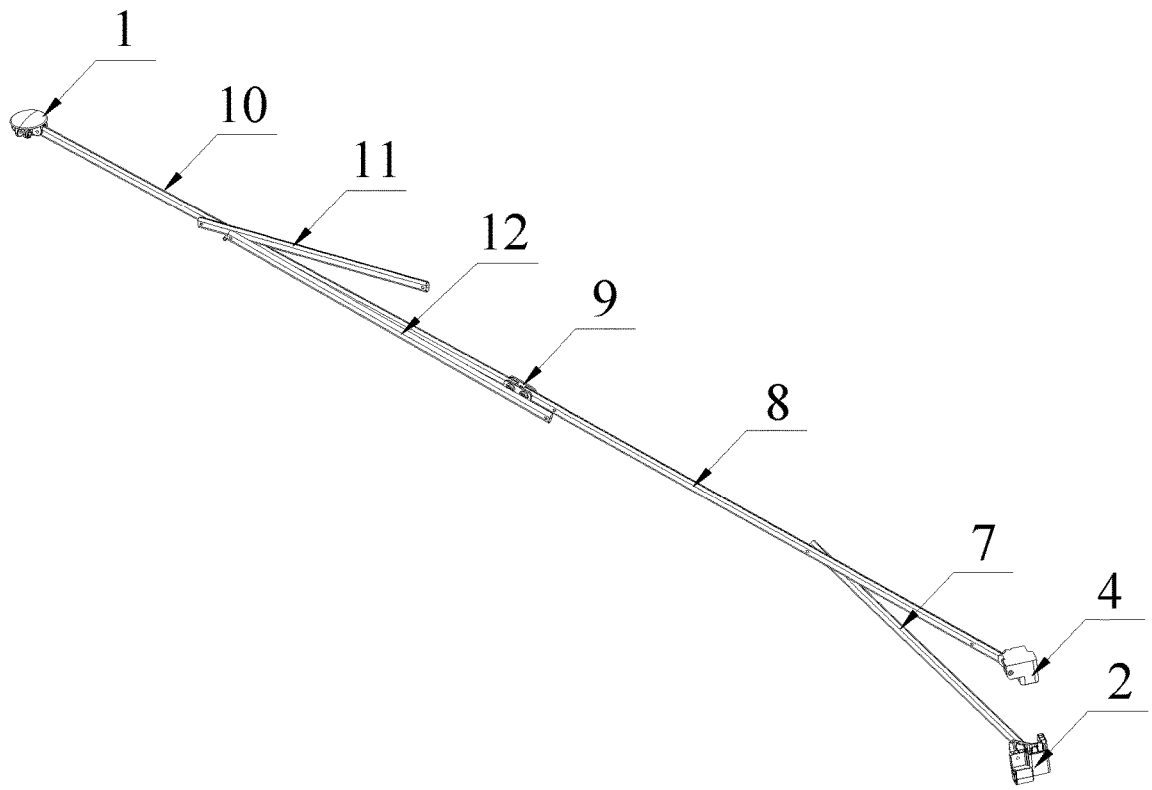
FIG. 10 is a solid diagram of a double-roof assembly according to the disclosure.
Figure 11:
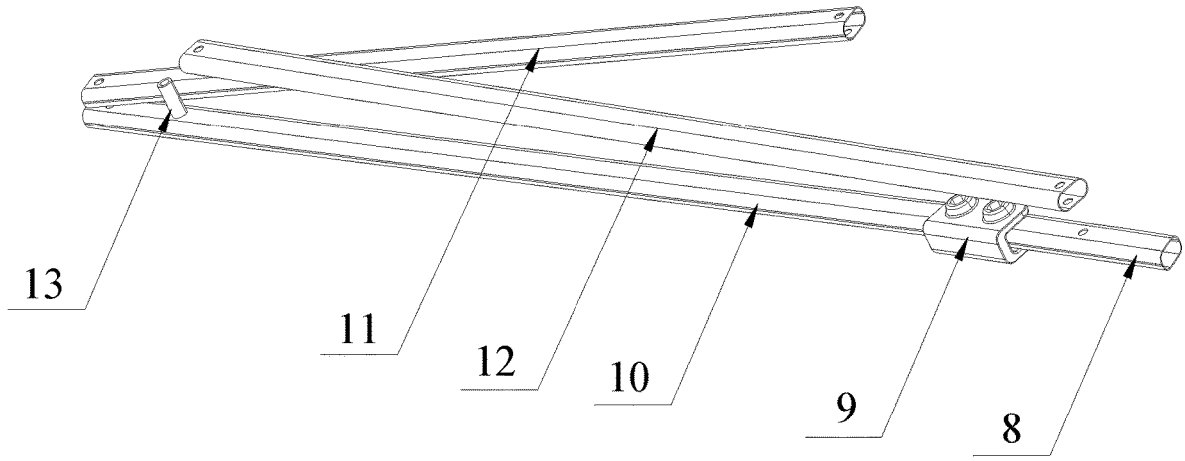
FIG. 11 is a solid sectional view of part of a double-roof assembly according to the disclosure.
Figure 12:
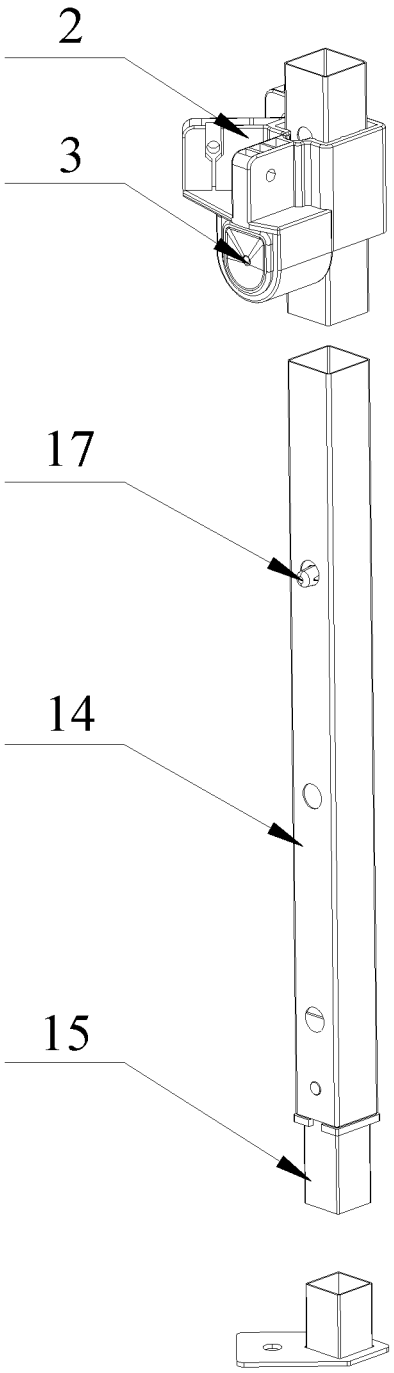
FIG. 12 is a solid diagram of part of a movable supporting rod and a fixed supporting rod according to the disclosure.
Figure 13:
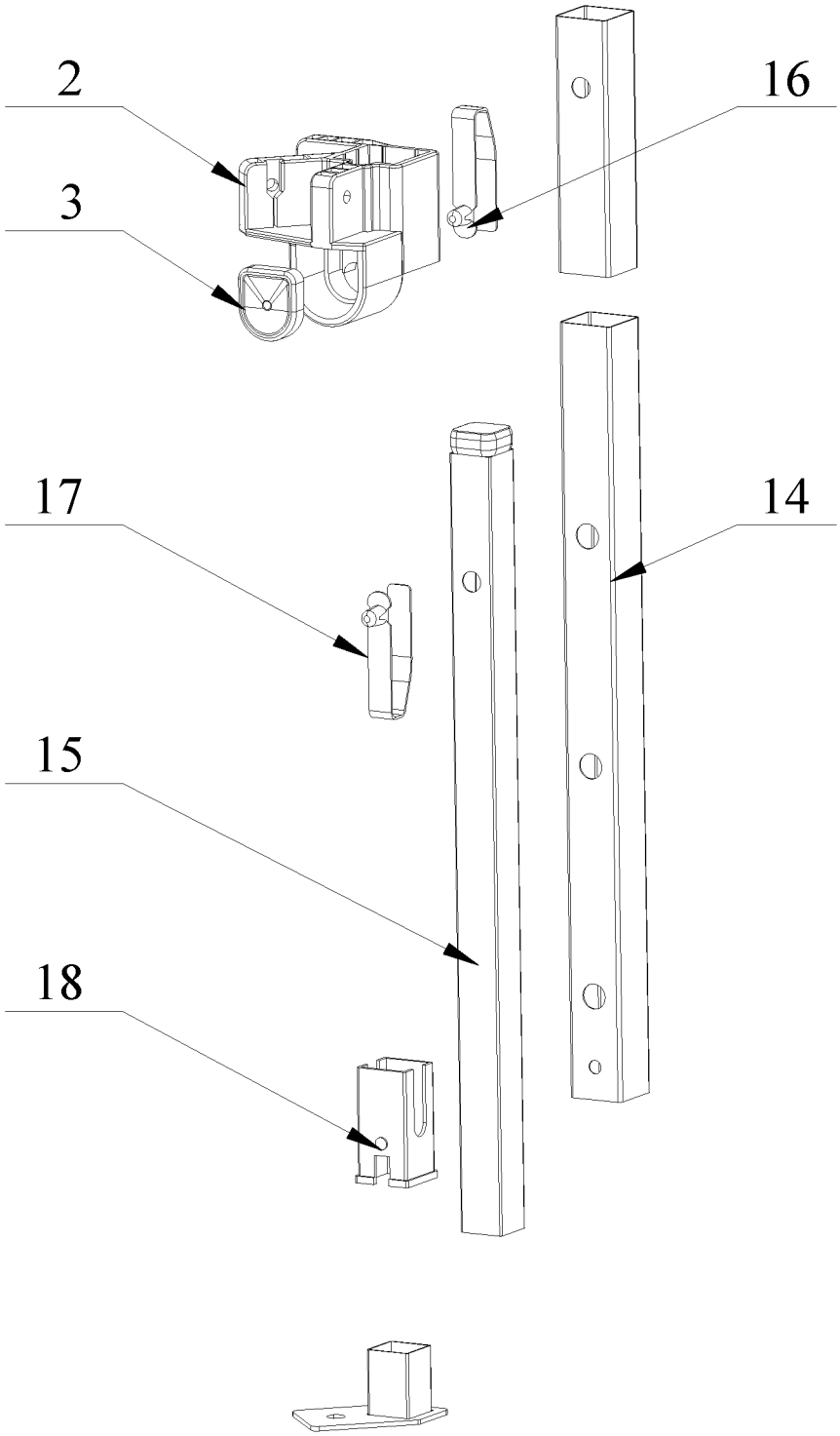
FIG. 13 is a solid exploded sectional view of part of a movable supporting rod and a fixed supporting rod according to the disclosure.
Figure 14:
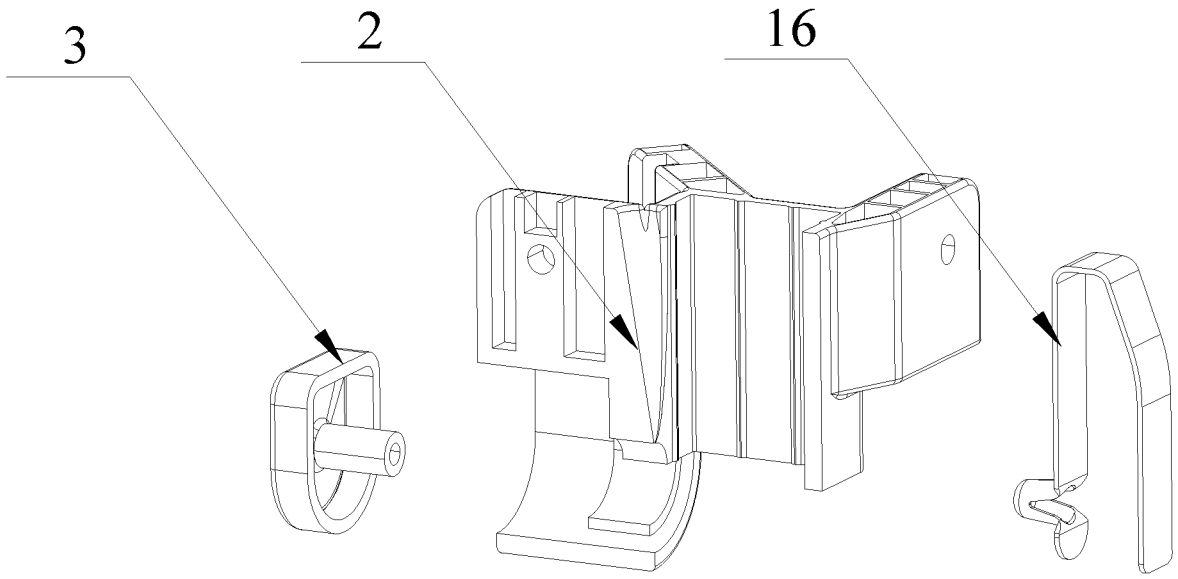
FIG. 14 is a solid exploded sectional view of part of a connection relation between a fastener button and a leaf spring I according to the disclosure.

In the figures: 1 tent roof connection block, 2 fastener block, 3 fastener button, 4 corner connection block, 5 foldable supporting rod I, 6 foldable supporting rod II, 7 short rod, 8 long rod, 9 connection block, 10 connection rod, 11 double-roof rod, 12 double-roof linkage rod, 13 fastener post, 14 movable supporting rod, 15 fixed supporting rod, 16 leaf spring I, 17 leaf spring II, and 18 rod sleeve.

DETAILED DESCRIPTION

The implementation of the disclosure is described below with reference to particular specific embodiments. Other advantages and effects of the disclosure will be readily apparent to those skilled in the art from the contents disclosed in the description. Apparently, embodiments described herein are some embodiments rather than all embodiments of the disclosure. Based on the embodiments in the disclosure, all other embodiments derived by those of ordinary skill in the art without creative efforts fall within the scope of protection of the disclosure.

With reference to FIGS. 1-15, the disclosure provides a double-roof foldable tent. The double-roof foldable tent includes a tent roof connection block 1, where a plurality of double-roof assemblies are arranged at a bottom of the tent roof connection block 1, the double-roof assemblies include connection rods 10, the connection rods 10 are arranged at the bottom of the tent roof connection block 1, one sides of the connection rods 10 are fixedly connected to fastener posts 13, the one sides of the connection rods 10 are provided with double-roof rods 11, and one sides of the double-roof rods 11 are provided with double-roof linkage rods 12; one ends of the connection rods 10 are connected to connection blocks 9, the other ends of the connection blocks 9 are connected to long rods 8, the other ends of the long rods 8 are connected to corner connection blocks 4, one sides of the long rods 8 are provided with short rods 7, and one ends of the short rods 7 are connected to fastener blocks 2; fastener buttons 3 are arranged inside the fastener blocks 2, movable supporting rods 14 are inserted into the fastener blocks 2 and the corner connection blocks 4, the movable supporting rods 14 are internally fixedly connected to leaf springs I 16, fixed supporting rods 15 are inserted into the movable supporting rods 14, the fixed supporting rods 15 are internally fixedly provided with leaf springs II 17, the fixed supporting rods 15 are snapped into rod sleeves 18, and the rod sleeves 18 are fixedly connected to inner walls of the movable supporting rods 14; and a foldable unit is arranged between every two double-roof assemblies, and the foldable unit includes a foldable supporting rod I 5 and a foldable supporting rod II 6.

In the implementation, in order to realize the objectives of forming tent cloth laid on a top of the tent into a double-roof structure, reducing the wind resistance, improving the stability, and improving ventilation, when the tent is unfolded, the long rods 8, the connection blocks 9, the connection rods 10, and the double-roof linkage rods 12 are in a parallel state, and lower-layer tent cloth is laid on an exterior of the tent. Moreover, the double-roof rods 11 are lifted up, and the double-roof rods 11 lifted are supported by the fastener posts 13. Upper-layer tent cloth is laid along the plurality of double-roof rods 11, so that the tent of the double-roof structure is formed. After the tent is unfolded, a ventilation gap is formed between the upper-layer tent cloth supported by the double-roof rods 11 and the lower-layer tent cloth supported by the long rods 8 and the connection rods 10. Accordingly, more wind passes through the gap, and a ventilation effect is better. Since wind passes through the gap, less wind blows to a tent body, the wind resistance is smaller, the use stability is improved, and air inside the tent can flow sufficiently.

In order to fold the tent conveniently, the device employs the technical solution as follows: tops of the connection rods 10 are movably connected to the tent roof connection block 1 through rotary shafts, the connection rods 10 are movably connected to the double-roof rods 11 through rotary shafts, and bottoms of the connection rods 10 are movably connected to the connection blocks 9 through rotary shafts; and tops of the double-roof linkage rods 12 are movably connected to the double-roof rods 11 through rotary shafts, bottoms of the double-roof linkage rods 12 are movably connected to the long rods 8 through rotary shafts, tops of the long rods 8 are movably connected to the connection blocks 9 through rotary shafts, bottoms of the long rods 8 are movably connected to the corner connection blocks 4 through rotary shafts, tops of the short rods 7 are movably connected to the long rods 8 through rotary shafts, and bottoms of the short rods 7 are movably connected to the fastener blocks 2 through rotary shafts. The fastener buttons 3 are pressed and move inside the fastener blocks 2, so that the leaf springs I 16 are retracted into the movable supporting rods 14, and the limitation on movement of the fastener blocks 2 along the movable supporting rods 14 is released. The plurality of fastener blocks 2 are dragged downwards, when the fastener blocks 2 move downwards, the foldable supporting rod I 5 and the foldable supporting rod II 6 are folded towards each other through the cooperation between the foldable supporting rod I 5 as well as the foldable supporting rod II 6 and the rotary shaft connected to the foldable supporting rod I and the foldable supporting rod II. Moreover, when the fastener blocks 2 move downwards, the long rods 8 are bent downwards through the short rods 7. The long rods 8 and the connection rods 10 are folded through the cooperation between the connection blocks 9 and the rotary shafts connected to the long rod and the connection rods. The long rods 8 enable the double- roof linkage rods 12 to push the double-roof rods 11 to rotate counterclockwise about the rotary shafts connected to the connection rods 10 towards the tent roof connection block 1 through the rotary shafts connected to the long rods. When the fastener blocks 2 move to the leaf springs II 17, the fastener buttons 3 are re-pressed, so that the leaf springs II 17 are retracted into the fixed supporting rods 15, and the limitation on movement of the movable supporting rods 14 along the fixed supporting rods 15 is released. Accordingly, the movable supporting rods 14 slide along the fixed supporting rods 15 through the rod sleeves 18. The fixed supporting rods 15 are stored inside the movable supporting rods 14, so that the tent contracts to be folded as a whole, and is convenient to store.

In order to realize the objective of folding the double-rood assemblies when the fastener blocks 2 move downwards, the device employs the technical solution as follows: the corner connection blocks 4 are fixedly arranged at tops of the movable supporting rods 14, the movable supporting rods 14 are snapped into the fastener blocks 2, and the fastener blocks are slidably connected to the movable supporting rods 14; a top of the foldable supporting rod I 5 is movably connected to one corner connection block 4 through a rotary shaft, and a bottom of the foldable supporting rod I 5 is movably connected to one fastener block 2 through a rotary shaft; a top of the foldable supporting rod II 6 is movably connected to another corner connection block 4 through a rotary shaft, and a bottom of the foldable supporting rod II 6 is movably connected to another fastener block 2 through a rotary shaft; and an intersection between the foldable supporting rod I 5 and the foldable supporting rod II 6 is movably connected through a rotary shaft. The fastener buttons 3 are pressed and move inside the fastener blocks 2, so that the leaf springs I 16 are retracted into the movable supporting rods 14, and the limitation on movement of the fastener blocks 2 along the movable supporting rods 14 is released. The plurality of fastener blocks 2 are dragged downwards, when the fastener blocks 2 move downwards, the foldable supporting rod I 5 and the foldable supporting rod II 6 are folded towards each other through the cooperation between the foldable supporting rod I 5 as well as the foldable supporting rod II 6 and the rotary shaft connected to the foldable supporting rod I and the foldable supporting rod II. The foldable supporting rod I 5 and the foldable supporting rod II 6 are folded, so that a plurality of movable supporting rods 14 move close to one another. Moreover, the fastener blocks 2 drive the long rods 8 to bend downwards through the short rods 7, so that the double-roof assemblies are folded.

Figure 15:
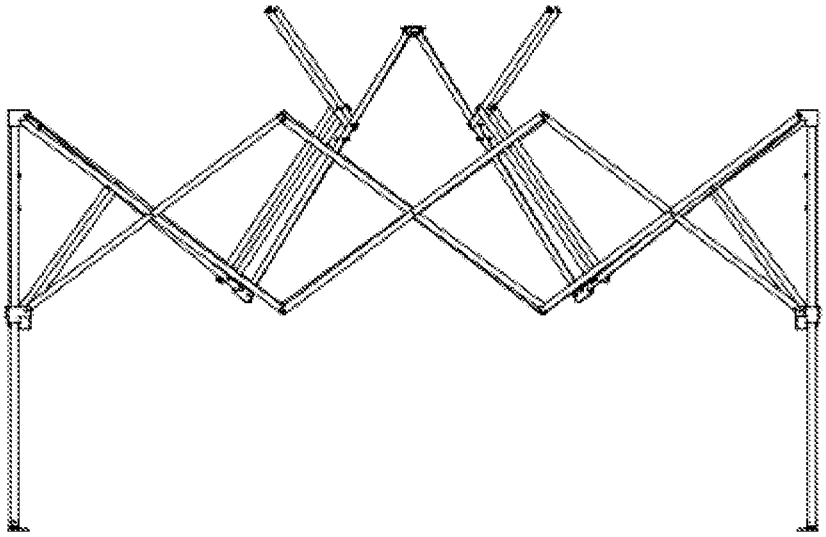
FIG. 15 is a flowchart of a folding process of an entire structure according to the disclosure.

A use process of the disclosure is as follows: when the disclosure is used, the tent is unfolded, as shown in FIG. 1, the long rods 8, the connection blocks 9, the connection rods 10, and the double-roof linkage rods 12 are in the parallel state, and the lower-layer tent cloth is laid on an exterior of the tent. Moreover, the double-roof rods 11 are lifted up, and the double-roof rods 11 lifted are supported by the fastener posts 13. Upper-layer tent cloth is laid along the plurality of double-roof rods 11, so that the tent of the double-roof structure is formed. After the tent is unfolded, the ventilation gap is formed between the upper-layer tent cloth supported by the double-roof rods 11 and the lower-layer tent cloth supported by the long rods 8 and the connection rods 10. Accordingly, more wind passes through the gap, and the ventilation effect is better. Since the wind passes through the gap, less wind blows to the tent body, the wind resistance is smaller, the use stability is improved, and the air inside the tent can flow sufficiently. The fastener buttons 3 are pressed and move inside the fastener blocks 2, so that the leaf springs I 16 are retracted into the movable supporting rods 14, and the limitation on movement of the fastener blocks 2 along the movable supporting rods 14 is released. The plurality of fastener blocks 2 are dragged downwards, when the fastener blocks 2 move downwards, the foldable supporting rod I 5 and the foldable supporting rod II 6 are folded towards each other through the cooperation between the foldable supporting rod I 5 as well as the foldable supporting rod II 6 and the rotary shaft connected to the foldable supporting rod I and the foldable supporting rod II. Moreover, when the fastener blocks 2 move downwards, the long rods 8 are bent downwards through the short rods 7. The long rods 8 and the connection rods 10 are folded through the cooperation between the connection blocks 9 and the rotary shafts connected to the long rods and the connection rods. The long rods 8 enable the double-roof linkage rods 12 to push the double-roof rods 11 to rotate counterclockwise about the rotary shafts connected to the connection rods 10 towards the tent roof connection block 1 through the rotary shafts connected to the long rods (as shown in FIG. 15). When the fastener blocks 2 move to the leaf springs II 17, the fastener buttons 3 are re-pressed, so that the leaf springs II 17 are retracted into the fixed supporting rods 15, and the limitation of movement of the movable supporting rods 14 along the fixed supporting rods 15 is released. Accordingly, the movable supporting rods 14 slide along the fixed supporting rods 15 through the rod sleeves 18. The fixed supporting rods 15 are stored inside the movable supporting rods 14, so that the tent contracts to be folded as a whole, and is convenient to store.

What are described above are merely preferred embodiments of the disclosure. Those skilled in the art may modify the disclosure or modify the disclosure into equivalent technical solutions on the basis of the technical solutions described above. Therefore, any simple modification or equivalent substitution according to the technical solutions of the disclosure falls within the scope of protection claimed by the disclosure.

What is claimed is:

1. A double-roof foldable tent, comprising a tent roof connection block (1), wherein a plurality of double-roof assemblies are arranged at a bottom of the tent roof connection block (1), the double-roof assemblies comprise connection rods (10), the connection rods (10) are arranged at the bottom of the tent roof connection block (1), one sides of the connection rods (10) are fixedly connected to fastener posts (13), the one sides of the connection rods (10) are provided with double-roof rods (11), and one sides of the double-roof rods (11) are provided with double-roof linkage rods (12); one ends of the connection rods (10) are connected to connection blocks (9), the other ends of the connection blocks (9) are connected to long rods (8), the other ends of the long rods (8) are connected to corner connection blocks (4), one sides of the long rods (8) are provided with short rods (7), and one ends of the short rods (7) are connected to fastener blocks (2); fastener buttons (3) are arranged inside the fastener blocks (2), movable supporting rods (14) are inserted into the fastener blocks (2) and the corner connection blocks (4), the movable supporting rods (14) are internally fixedly connected to leaf springs I (16), fixed supporting rods (15) are inserted into the movable supporting rods (14), the fixed supporting rods (15) are internally fixedly provided with leaf springs II (17), the fixed supporting rods (15) are snapped into rod sleeves (18), and the rod sleeves (18) are fixedly connected to inner walls of the movable supporting rods (14); and a foldable unit is arranged between every two double-roof assemblies, and the foldable unit comprises a foldable supporting rod I (5) and a foldable supporting rod II (6);

the connection rods (10) are movably connected to the double-roof rods (11) through rotary shafts, bottoms of the connection rods (10) are movably connected to the connection blocks (9) through rotary shafts, and tops of the long rods (8) are movably connected to the connection blocks (9) through rotary shafts; tops of the double-roof linkage rods (12) are movably connected to the double-roof rods (11) through rotary shafts, and bottoms of the double-roof linkage rods (12) are movably connected to the long rods (8) through rotary shafts;

when the tent is unfolded, the double-roof rods (11) are lifted up, and the double-roof rods (11) lifted are supported by the fastener posts (13);

when the tent is to be folded, the fastener buttons (3) are pressed and move inside the fastener blocks (2), so that the leaf springs I (16) are retracted into the movable supporting rods (14), and a first limitation on movement of the fastener blocks (2) along the movable supporting rods (14) is released; when the fastener blocks (2) move downwards to the leaf springs II (17), the fastener buttons (3) are re-pressed, so that the leaf springs II (17) are retracted into the fixed supporting rods (15), and a second limitation on movement of the movable supporting rods (14) along the fixed supporting rods (15) is released.

2. The double-roof foldable tent according to claim 1, wherein tops of the connection rods (10) are movably connected to the tent roof connection block (1) through rotary shafts.

3. The double-roof foldable tent according to claim 1, wherein bottoms of the long rods (8) are movably connected to the corner connection blocks (4) through rotary shafts.

4. The double-roof foldable tent according to claim 1, tops of the short rods (7) are movably connected to the long rods (8) through rotary shafts, and bottoms of the short rods (7) are movably connected to the fastener blocks (2) through rotary shafts.

5. The double-roof foldable tent according to claim 1, wherein the corner connection blocks (4) are fixedly arranged at tops of the movable supporting rods (14).

6. The double-roof foldable tent according to claim 1, wherein the movable supporting rods (14) are snapped into the fastener blocks (2), and the fastener blocks are slidably connected to the movable supporting rods (14).

7. The double-roof foldable tent according to claim 1, wherein an intersection between the foldable supporting rod I (5) and the foldable supporting rod II (6) is movably connected through a rotary shaft; a top of the foldable supporting rod I (5) is movably connected to one corner connection block (4) through a rotary shaft, and a bottom of the foldable supporting rod I (5) is movably connected to one fastener block (2) through a rotary shaft; and a top of the foldable supporting rod II (6) is movably connected to another corner connection block (4) through a rotary shaft, and a bottom of the foldable supporting rod II (6) is movably connected to another fastener block (2) through a rotary shaft.

8. The double-roof foldable tent according to claim 1, wherein one sides of the leaf springs I (16) are fixedly provided with bulges I, and the bulges I penetrate one side walls of the movable supporting rods (14) and extend into the fastener blocks (2).

9. The double-roof foldable tent according to claim 1, wherein one sides of the leaf springs II (17) are fixedly provided with bulges II, and the bulges II penetrate one side walls of the movable supporting rods (14) and the fixed supporting rods (15).

* * * * *